US009398678B2

(12) United States Patent
Aanesland et al.

(10) Patent No.: US 9,398,678 B2
(45) Date of Patent: Jul. 19, 2016

(54) METHOD AND DEVICE FOR FORMING A PLASMA BEAM

(75) Inventors: Ane Aanesland, Paris (FR); Pascal Chabert, Paris (FR); Michael Irzyk, Melun (FR); Stéphane Mazouffre, Orléans (FR)

(73) Assignees: ASTRIUM SAS, Suresnes (FR); ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 250 days.

(21) Appl. No.: 13/825,913

(22) PCT Filed: Sep. 14, 2011

(86) PCT No.: PCT/FR2011/052090

§ 371 (c)(1),
(2), (4) Date: Jun. 26, 2013

(87) PCT Pub. No.: WO2012/042143

PCT Pub. Date: Apr. 5, 2012

(65) Prior Publication Data

US 2013/0300288 A1 Nov. 14, 2013

(30) Foreign Application Priority Data

Sep. 30, 2010 (FR) ..... 10 57890

(51) Int. Cl.
*H01J 7/24* (2006.01)
*H05B 31/26* (2006.01)
(Continued)

(52) U.S. Cl.
CPC ..... *H05H 1/24* (2013.01); *F03H 1/0025* (2013.01); *H01J 27/024* (2013.01); *H01J 27/16* (2013.01); *H05H 1/54* (2013.01)

(58) Field of Classification Search
CPC .. B64C 2230/12; B64C 27/18; B64C 23/005; F03H 1/0087; F03H 1/0062; H05H 1/54; Y02T 50/166; F15D 1/12; F05D 2270/172
USPC ..... 315/111.61, 111.31
See application file for complete search history.

(56) References Cited

U.S. PATENT DOCUMENTS 5,156,703 A 10/1992 Oechsner
7,144,520 B2 * 12/2006 Ichiki ..... H01J 37/321 204/192.3

(Continued)

FOREIGN PATENT DOCUMENTS

EP 1 220 272 A1 7/2002
EP 1 672 966 A2 6/2006
WO 2005/003717 A2 1/2005

OTHER PUBLICATIONS

International Search Report mailed Dec. 22, 2011, in connection with International Application No. PCT/FR2011/052090, filed Sep. 14, 2011.

*Primary Examiner* — Lincoln Donovan
*Assistant Examiner* — Diana J Cheng
(74) *Attorney, Agent, or Firm* — Duane Morris LLP; J. Rodman Steele, Jr.; Gregory M. Lefkowitz

(57) ABSTRACT

The invention relates to a method and device for forming a plasma beam. According to the invention: the quality of the electroneutrality of the plasma beam (PB) is detected (in 12 and/or 13); and the alternating polarization potentials of the extraction and acceleration grid (4) are adjusted such that the plasma beam (PB) is at least approximately electrically neutral.

20 Claims, 2 Drawing Sheets

(51) Int. Cl.

| | |
|---|---|
| ***H05H 1/24*** | (2006.01) |
| ***H01J 27/02*** | (2006.01) |
| ***H01J 27/16*** | (2006.01) |
| ***H05H 1/54*** | (2006.01) |
| ***F03H 1/00*** | (2006.01) |

(56) References Cited

U.S. PATENT DOCUMENTS

| | | | | |
|---|---|---|---|---|
| 7,183,515 | B2 * | 2/2007 | Miller et al. | 219/121.5 |
| 2006/0019477 | A1 | 1/2006 | Hanawa et al. | |

* cited by examiner

METHOD AND DEVICE FOR FORMING A PLASMA BEAM

CROSS-REFERENCE TO RELATED APPLICATIONS

This application is a 0371 national stage entry of International Application No. PCT/FR2011/052090, filed Sep. 14, 2011, which claims priority to French Patent Application No. 1057890, filed Sep. 30, 2010, the entire contents of which are incorporated herein by reference.

The present invention concerns a method and a device for forming a plasma beam.

It is known that certain techniques, such as the etching of semiconductor devices, space propulsion, magnetically confined fusion, biotechnology, etc., use electrically neutral plasma beams, which can be obtained by different methods.

The best-known method, cited as prior art in documents WO 2004/002201, WO 2007/065315 and WO 2010/060887, consists of extracting and accelerating positive ions from a plasma via negatively-biased grids, and then using an auxiliary electron beam to neutralise the flow of ions thus obtained in order to form an electrically neutral plasma beam. Of course, this first method has the disadvantage of requiring an auxiliary source of electrons.

Another method is that which is the subject of documents WO 2007/065915 and WO 2010/060887 and which consists of extracting and accelerating positive ions and negative ions from a plasma via at least two grids biased negatively and positively respectively and of combining the flow of said positive ions and the flow of said negative ions to form an electrically neutral plasma beam. This method has the advantage of combining the positive ions and the negative ions extremely rapidly (approximately $5\times10^{-8}$ $cm^3/s$), particularly if they originate from a single source, but it can be difficult to implement due to the simultaneous presence of grids with an opposite bias.

Yet another method (see, for example, documents EP 1 220 272 A1 and U.S. Pat. No. 5,156,703) consists of extracting and accelerating the positive ions and the negatively-charged particles from the plasma by subjecting an extraction and acceleration grid to bias potentials that are alternately positive and negative. In this method, said grid extracts and accelerates positive particles (in other words, positive ions) and negative particles (which can be negative ions or electrons) alternately from the plasma, said positive and negative particles then combining to neutralise their charges. However, experience has shown that, in practice, the quality of the electrical neutrality of a plasma beam obtained in this way is not the best.

The object of the present invention is to improve this last known method, in order to obtain greater electrical neutrality of the plasma beam.

To that end, according to the invention, the method for forming a plasma beam by extracting and accelerating electrically-charged particles from a plasma and using at least one extraction and acceleration grid subjected to bias potentials that are alternately positive and negative is notable in that:

- the quality of the electrical neutrality of said plasma beam is detected; and
- said bias potentials are adjusted so that said plasma beam is at least approximately electrically neutral.

The present invention makes use of the fact that the number of positive and negative particles extracted and accelerated depends on the duration and the amplitude of the positive and negative potentials applied to said extraction and acceleration grid.

The result is that adjusting the duration and/or the amplitude of the positive and/or the negative bias potentials acts, in accordance with the invention, on the qualify of the electrical neutrality of the plasma beam. An adjustment of this kind can be performed in real time, via, for example, analysis of the grid currents or by an external sensor monitoring said plasma beam.

In order to further improve the quality of the electrical neutrality of the plasma beam. It is advantageous for the frequency of alternation of the positive and negative bias potentials to be a radio-frequency included in the range between a few kHz and a few MHz, in other words, for the duration for which a positive or negative potential is applied to said extraction and acceleration grid to be included in the range between a few ms and a few μs. Experience has shown that such a frequency promotes the combination of positive and negative particles.

In the case where said plasma is pulsed, it is also advantageous for this alternating sequence of positive and negative bias potentials to be synchronised with the pulsing of the plasma and for the positive ions to be extracted from the plasma during the pulsing thereof, while the negative particles are extracted in the intervals between said pulsings.

The alternating sequence of positive and negative bias potentials may have any appropriate continuous form, for example sinusoidal. However, it preferably takes the form of a sequence of rectangular waves with steep edges, in which the rise time is approximately the transit time of the ions, or faster.

Preferably, the positive and negative potentials used to bias said extraction and acceleration grid amount to several hundred volts, for example 400 volts.

The present invention also relates to a device for implementing the method described above. Such a device according to the invention, which has a plasma generator provided with at least one grid to extract and accelerate electrically charged particles from said plasma, and also means for the electrical biasing of said grid, producing bias potentials that are alternately positive and negative, is notable in that it has a detector delivering a signal representing the quality of the electrical neutrality of said plasma beam and in that said means for electrical biasing is controlled by said detector so that said plasma beam is at least approximately electrically neutral.

A detector of this kind can be a sensor, for example an induction sensor, monitoring said plasma beam, or a current sensor in a grid of said device. To that end, it is advantageous that:

- at least one additional grid connected to the earth or to a slightly negative potential is disposed downstream of the extraction and polarisation grid; and
- said electrical current sensor checks for the presence of any current in said additional grid.

Preferably, said electrical biasing means has a MOSFET rapid switch, switching alternately between the two opposed polarities.

The plasma generator device according to the present invention can also have means for synchronising the electrical biasing means with the pulsing of the plasma.

The accompanying drawings will give a clear understanding as to how the invention may be embodied. In these drawings, identical reference numerals refer to similar elements.

Figure 1:
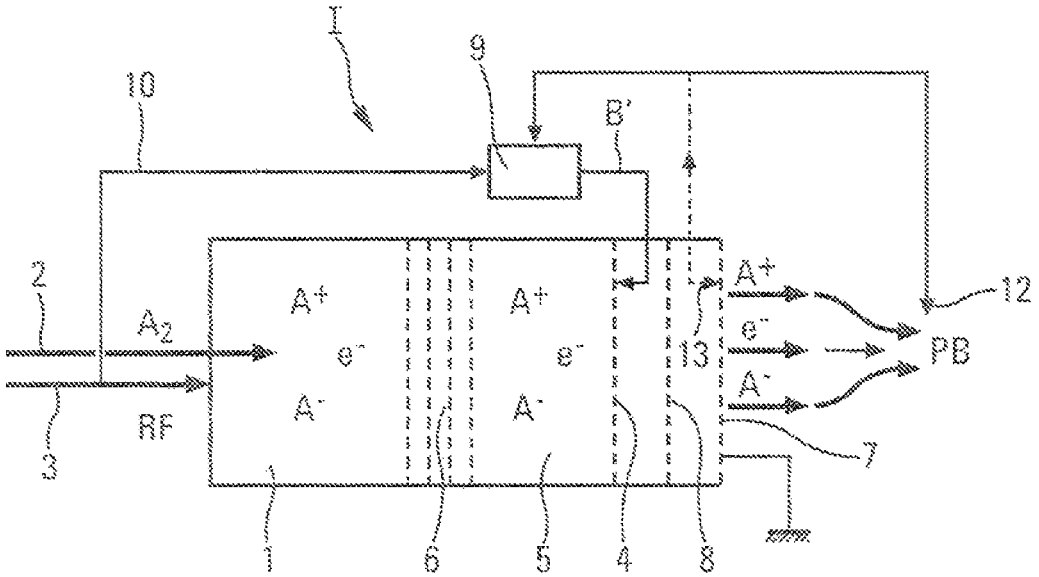
FIG. 1 is a block diagram of an embodiment of the device according to the present invention.

The plasma generation device I, according to the present invention and shown diagrammatically in FIG. 1, has a plasma core 1 supplied with ionisable gas A2 by a supply 2, said gas A2 being ionised under the action of a continuous radio-frequency electric field RF referenced in the diagram as 3. Thus, a continuous plasma comprising positive ions $A^+$, negative ions $A^-$ and electrons $e^-$ is generated in the plasma core 1.

The plasma generation device I has a grid 4 in contact with the plasma in order to be able to extract and accelerate the positive ions $A^+$ and the negative ions $A^-$ from the plasma situated in the adjacent area 5, after eliminating the electrons $e^-$, for example via a magnetic filter 6. A grid 7 connected to the earth or to a slightly negative potential (for example approximately −10V) is disposed upstream from the extraction and acceleration grid 4. An intermediate grid 8, which is negatively biased, could be disposed between the grids 4 and 7. The grid 4 could be replaced by an internal electrode in the plasma core 1, the bias potentials then being applied to this internal electrode and the grids 8 and 7 being used as before.

The extraction and acceleration grid 4 is biased alternately positively and negatively via an electrical biasing device 9, comprising for example a MOSFET rapid switch able to switch two opposite electrical polarities rapidly, without the potential being exceeded significantly, "rapidly" meaning approximately the transit time of the ions.

Figure 2:
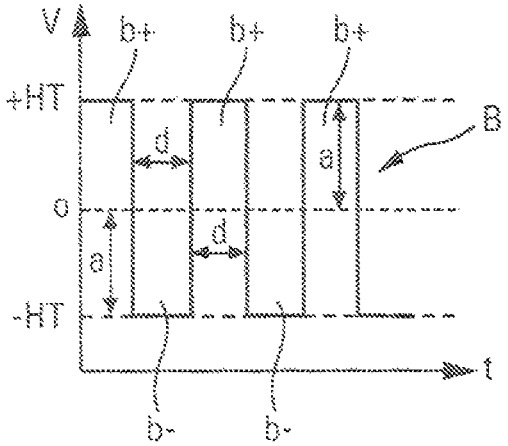
FIG. 2 is a timing diagram of an example of known electrical biasing applied to the extraction and acceleration grid of the device shown in FIG. 1.

A known example of a bias signal B at high voltage +HT, −HT (for example approximately 400V), capable of being applied to the grid 4, is shown in FIG. 2, which represents the voltage V (the ordinate) as a function of time t (the abscissa).

The bias signal B consists of an alternating sequence of positive rectangular waveforms with steep edges b+ (between 0 and +HT) and negative rectangular waveforms with steep edges b− (between 0 and −HT). In this bias signal B, all the positive bias waveforms b+ are of equal amplitude a and duration d and the same applies to the negative waveforms b− which, in addition, are identical to said positive waveforms, except in polarity.

If, in an ideal case where the filter 6 was perfect, so that no electron was to be found in the area 5 adjacent to the acceleration and extraction grid 4, and where the bias signal B was applied to said grid:

- when a positive waveform b+ suddenly appeared on the grid 4 in contact with the plasma in the area 5, a negative sheath would form which would accelerate the positive ions $A^+$ and block the negative ions $A^-$;
- conversely, when a positive waveform b− suddenly appeared on said grid 4, a positive sheath would form which would accelerate the negative ions $A^-$ and block the positive ions $A^+$.

Thus, in this ideal case, at the output from the generator I there would then appear, alternately but almost simultaneously, as many positive ions $A^+$ as negative ions $A^-$, which would combine and form the electrically neutral plasma beam PB.

However, in reality, for various reasons (for example, because the magnetic filter 6 is not perfect) some electrons $e^-$ are to be found in the area 5 adjacent to the extraction and acceleration grid 4, and therefore at the outlet from the plasma [beam] generation device, so that the plasma beam PB, which results from the grid 4 being biased by the biasing signal B, cannot be electrically neutral.

In order to remedy this disadvantage, according to the present invention, the electrical biasing device 9 is controllable and is able to produce a biasing signal B' consisting of a sequence of positive rectangular waveforms b'+ and negative rectangular waveforms b'− whose amplitude a' and duration d' can be varied.

In addition, the device I has a sensor 12, for example an induction sensor, capable of detecting a lack of electrical neutrality in the beam PB and of acting on the controllable electrical biasing device 9 so that said device varies the amplitude a' and/or the duration d' of the positive waveforms b'+ and/or the negative waveforms b'−, in order to make this lack of neutrality disappear. Thus, the plasma beam PB can be made electrically neutral in real time.

Figure 3:
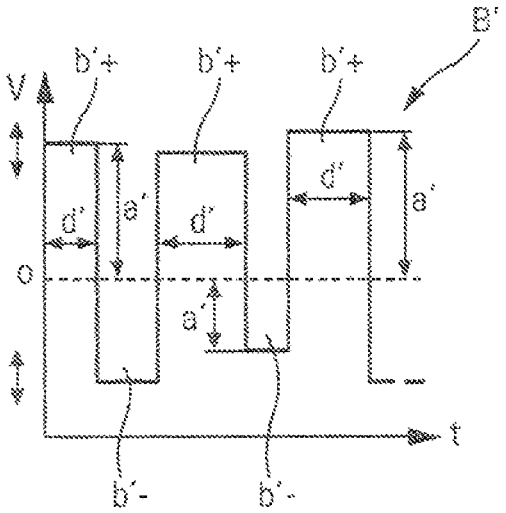
FIG. 3 is a timing diagram for a diagrammatic example of electrical biasing according to the present invention, applied to the extraction and acceleration grid of the device shown in FIG. 1.

FIG. 3 shows a further example of such waveforms b'+ and b'−, with different amplitude a and duration d', adjusted to make the plasma beam PB electrically neutral.

As a variant, the sensor 12 can be replaced by an electrical current sensor 13, monitoring, for example, for the presence of any current in the grid 7.

In addition, in order to further improve the electrical neutrality of the plasma beam PB, in the plasma generator I of FIG. 1, the ionising electric field RF is pulsed at a frequency much lower than the switching frequency and, as shown symbolically by line 10 of FIG. 1, the operation of the electrical biasing device 9, in other words, the emission of the biasing signal B', is synchronised with said pulsed ionising electric field RF so that the positive ions $A^+$ are extracted from the plasma during the pulsing thereof and so that the negative ions $A^-$ are extracted in the intervals between said pulsings, the electrons $e^-$ in the area 5 being rapidly lost during these intervals.

Figure 4:
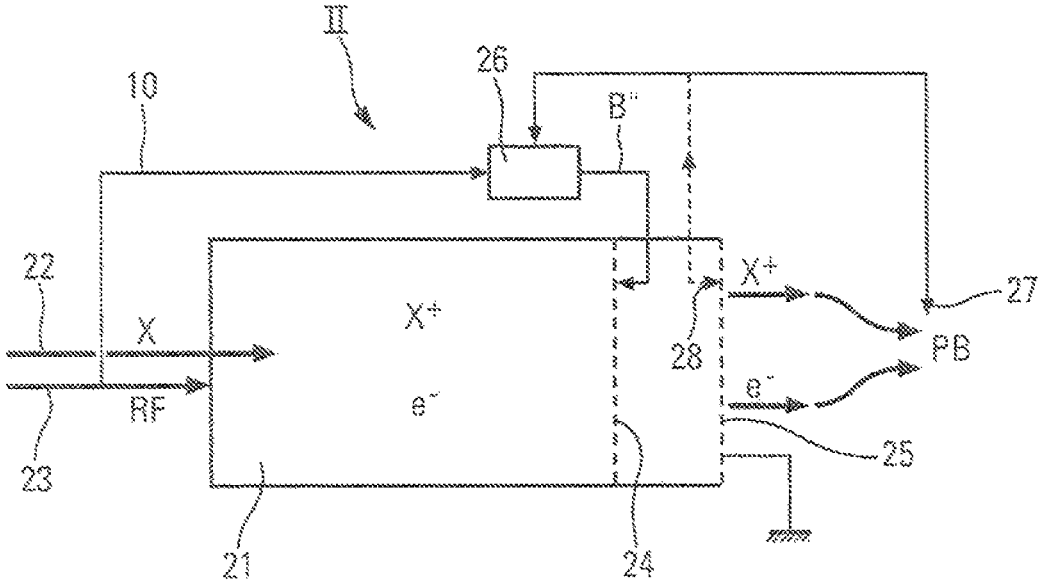
FIG. 4 is a block diagram of a variant embodiment of the device according to the present invention.

The plasma generation device II, according to the present invention and shown diagrammatically in FIG. 4, has a plasma core 21 supplied with electropositive gas X by a supply 22. This electropositive gas X is ionised by a radio-frequency electric field RF shown diagrammatically as 23 and produces positive ions $X^+$ and electrons $e^-$. The charged particles, i.e. the positive ions $X^+$ and the electrons $e^-$, are extracted and accelerated by a grid 24, in contact with the plasma. A grid (or a set of grids) 25, connected to the earth or to a slightly negative potential, cooperates with the grid 24.

This extraction and acceleration grid 24 is biased by an electrical biasing device 26, of the same type as the device 9 described above, capable of issuing a signal B" consisting of a series of positive waveforms b"+ and negative waveforms b"− whose amplitude a" and duration d" can be varied.

Figure 5:
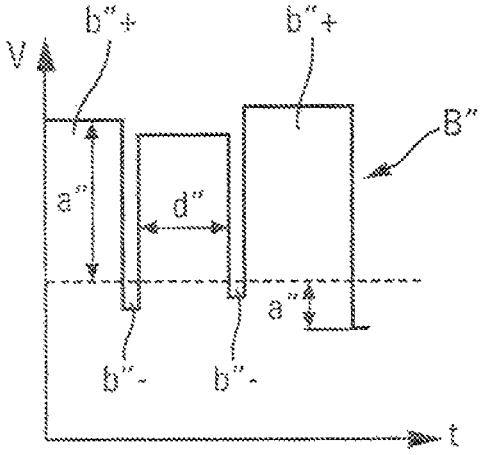
FIG. 5 is a timing diagram giving a diagrammatic illustration of the variable electrical bias applied to the extraction and acceleration grid of the device shown in FIG. 4.

In a similar manner to that described above as regards the device I, the positive ions $X^+$ are extracted and accelerated during the positive waveforms b"+ and the electrons $e^-$ are extracted and accelerated during the negative waveforms b"−. Given the differences in mass and mobility between the positive ions $X^+$ and the electrons $e^-$, the duration and the amplitude of the negative waveforms b"− are very much less than those of the positive waveforms b"−, as can be seen in FIG. 5.

In addition, the device II has a sensor 27, for example an induction sensor (or a sensor 28 monitoring for the presence of electrical current in the grid 25), capable of detecting a lack of electrical neutrality in the beam PB and of acting on the controllable electric biasing device 26 so that said device varies the amplitude a" and/or the duration d" of the positive waveforms b"+ and/or the negative waveforms b"−, in order to cause any lack of electrical neutrality in the plasma beam PB to disappear.

Thus, at the outlet of the plasma generator device II, ions $X^+$ and electrons $e^-$ appear which, by combining, form an electrically-neutral plasma beam PB, without the aid of an auxiliary source of electrons.

As described previously in relation to the plasma generation device I, a line 10 can ensure that the signal B" is synchronised with the pulsed ionising electric field RF.

The invention claimed is:

1. Method for forming a plasma beam (PB) by extracting and accelerating electrically-charged particles from a plasma and using at least one extraction and acceleration grid (4, 24) subjected to bias potentials generated by an electrical biasing device that are alternately positive and negative, comprising:

detecting the quality of the electrical neutrality of said plasma beam; and adjusting said bias potentials generated by the electrical biasing device so that said plasma beam is at least approximately electrically neutral, wherein the electrical neutrality of said plasma beam is obtained at least in part by adjusting the amplitude of said positive and/or negative potentials delivered by the electrical biasing device to said extraction and acceleration grid (4, 24).

2. Method according to claim 1, wherein the electrical neutrality of said plasma beam is obtained at least in part by adjusting the duration of application of said positive and/or negative potentials delivered by the electrical biasing device to said extraction and acceleration grid (4, 24).

3. Method according to claim 1, wherein the frequency of alternation of the positive and negative bias potentials is a radio frequency included in the range between a few kHz and a few MHz.

4. Method according to claim 1, wherein the alternating sequence of positive and negative potentials forms a continuous curve.

5. Method according to claim 4, wherein said continuous curve consists of rectangular waveforms with steep edges, alternately positive and negative.

6. Method according to claim 1, wherein said bias potentials are approximately 400 volts.

7. The method according to claim 1, wherein said adjusting is performed automatically in response to an electrical neutrality quality obtained during said detecting.

8. The method according to claim 1, wherein said detecting comprises detecting the quality of the electrical neutrality of said plasma beam with an electrical sensor.

9. Method for forming a plasma beam (PB) by extracting and accelerating electrically-charged particles from a plasma and using at least one extraction and acceleration grid (4, 24) subjected to bias potentials generated by an electrical biasing device that are alternately positive and negative, comprising:

detecting the quality of the electrical neutrality of said plasma beam; and adjusting said bias potentials generated by the electrical biasing device so that said plasma beam is at least approximately electrically neutral, wherein the plasma is pulsed, wherein the alternating sequence of positive and negative potentials is synchronised with the pulsings of the plasma, the positive ions being extracted from the plasma during said pulsings, while the negative particles are extracted in the intervals between said pulsings.

10. The method according to claim 3, wherein the electrical neutrality of said plasma beam is obtained at least in part by adjusting the duration of application of said positive and/or negative potentials delivered by the electrical biasing device to said extraction and acceleration grid (4, 24).

11. The method according to claim 3, wherein the frequency of alternation of the positive and negative bias potentials is a radio frequency included in the range between a few kHz and a few MHz.

12. The method according to claim 3, wherein the alternating sequence of positive and negative potentials forms a continuous curve.

13. The method according to claim 12, wherein said continuous curve consists of rectangular waveforms with steep edges, alternately positive and negative.

14. The method according to claim 3, wherein said bias potentials are approximately 400 volts.

15. The method according to claim 3, wherein said detecting comprises detecting the quality of the electrical neutrality of said plasma beam with an electrical sensor.

16. Device for forming a plasma beam (PB) having a plasma generator provided with at least one grid (4, 24) to extract and accelerate electrically-charged particles from said plasma, and also means for the electrical biasing (9, 26) of said grid, producing bias potentials that are alternately positive and negative, wherein said device comprises an electrical sensor (12, 13, 27, 28) delivering a signal representing the quality of the electrical neutrality of said plasma beam and in that said means for electrical biasing (9, 26) is controlled by said electrical sensor (12, 13, 27, 28) so that said plasma beam (PB) is at least approximately electrically neutral, further comprising means (10) for synchronising said electrical biasing means (9, 26) with the pulsing of said plasma.

17. Device according to claim 16, wherein said electrical sensor is an induction sensor (12, 27), capable of detecting a lack of electrical neutrality in said plasma beam (PB).

18. Device according to claim 16, wherein at least one additional grid (7, 25) connected to the earth or to a slightly negative potential is disposed downstream of the extraction and polarisation grid (4, 24); and said electrical sensor is an electrical current sensor (13, 28) checking for the presence of any current in said additional grid (7, 25).

19. Device according to claim 16, wherein said electrical biasing means (9, 26) has a MOSFET rapid switch.

20. Device according to claim 16, wherein said electrical biasing means (9, 26) delivers positive and negative potentials of approximately 400 volts.

* * * * *